US010954750B2

(12) United States Patent
Neacsu et al.

(10) Patent No.: US 10,954,750 B2
(45) Date of Patent: Mar. 23, 2021

(54) SUBSURFACE SAFETY VALVE WITH ROTATING DISK

(71) Applicant: Saudi Arabian Oil Company, Dhahran (SA)

(72) Inventors: Marius Neacsu, Dhahran (SA); Ahmed Al-Ramadhan, Dhahran (SA); Ahmed Al-Mousa, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 76 days.

(21) Appl. No.: 16/458,551

(22) Filed: Jul. 1, 2019

(65) Prior Publication Data

US 2021/0002979 A1 Jan. 7, 2021

(51) Int. Cl.

| | |
|---|---|
| ***E21B 34/14*** | (2006.01) |
| ***E21B 34/16*** | (2006.01) |
| *E21B 33/12* | (2006.01) |
| *E21B 34/00* | (2006.01) |
| *E21B 34/06* | (2006.01) |

(52) U.S. Cl.

CPC ..... *E21B 34/14* (2013.01); *E21B 34/16* (2013.01); *E21B 33/12* (2013.01); *E21B 34/00* (2013.01); *E21B 34/06* (2013.01); *E21B 2200/05* (2020.05)

(58) Field of Classification Search

CPC ..... E21B 34/00; E21B 34/06; E21B 34/063; E21B 34/14; E21B 34/16; E21B 33/12; E21B 2200/05

See application file for complete search history.

(56) References Cited

U.S. PATENT DOCUMENTS

| | | | | |
|---|---|---|---|---|
| 3,509,913 A * | 5/1970 | Lewis | E21B 34/10 137/614.11 |
| 3,830,297 A * | 8/1974 | Cockrell | E21B 34/101 166/322 |
| 4,220,176 A * | 9/1980 | Russell | E21B 34/08 137/496 |
| 4,667,736 A | 5/1987 | Rumbaugh et al. | |

(Continued)

FOREIGN PATENT DOCUMENTS

WO 2018236516 A1 12/2018

OTHER PUBLICATIONS

International Search Report and Written Opinion for related PCT application PCT/US2020/040382 dated Sep. 8, 2020.

*Primary Examiner* — Yong-Suk (Philip) Ro
(74) *Attorney, Agent, or Firm* — Bracewell LLP; Constance G. Rhebergen; Linda L. Morgan

(57) ABSTRACT

A subsurface safety valve assembly has a valve body with an axially oriented valve bore and a valve cavity that intersects the valve bore. A disk valve member is positioned within the valve cavity and has a disk bore. A piston member is moveable between a contracted position and an extended position, such that in the contracted position the disk valve member is in a valve closed position with the disk bore offset from the valve bore, and in the extended position the disk valve member is in a valve open position with the disk bore axially aligned with the valve bore. An uphole seal member circumscribes the valve bore, forming a seal between the uphole side of the disk valve member and the valve body. A downhole seal member circumscribes the valve bore, forming a seal between the downhole side of the disk valve member and the valve body.

18 Claims, 3 Drawing Sheets

(56) References Cited

U.S. PATENT DOCUMENTS

| | | | | |
|---|---|---|---|---|
| 5,029,597 | A | 7/1991 | Leon | |
| 5,179,973 | A | 1/1993 | Dickson et al. | |
| 5,856,609 | A * | 1/1999 | Wu | B01J 37/0201 208/135 |
| 6,619,388 | B2 * | 9/2003 | Dietz | E21B 34/066 166/332.8 |
| 6,988,556 | B2 | 1/2006 | Vick, Jr. | |
| 7,195,225 | B1 | 3/2007 | Holliday | |
| 8,453,749 | B2 | 6/2013 | Vick et al. | |
| 8,511,374 | B2 * | 8/2013 | Scott | E21B 34/066 166/66.6 |
| 8,857,785 | B2 * | 10/2014 | Bussear | F16K 31/025 251/11 |
| 9,057,236 | B2 | 6/2015 | Hgset et al. | |
| 9,441,453 | B2 | 9/2016 | Lymberopoulos et al. | |
| 2007/0251696 | A1 | 11/2007 | Parks | |
| 2012/0037360 | A1 * | 2/2012 | Arizmendi, Jr. | E21B 23/04 166/250.01 |
| 2014/0069639 | A1 | 3/2014 | MacKenzie et al. | |
| 2015/0191994 | A1 * | 7/2015 | Kobe | E21B 33/04 166/350 |
| 2016/0223089 | A1 | 8/2016 | Nijland | |
| 2018/0298724 | A1 | 10/2018 | Merrill et al. | |

* cited by examiner

SUBSURFACE SAFETY VALVE WITH ROTATING DISK

BACKGROUND OF THE DISCLOSURE

1. Field of the Disclosure

This disclosure relates generally to fluid flow control within a subterranean well and in particular, to subsurface safety valves located downhole within the subterranean well.

2. Description of the Related Art

A surface controlled subsurface safety valve can be used in the wellbore of a subterranean well to provide closure of the production tubing, such as in a case of an emergency. As an example, certain hydrocarbon development wells require a subsurface safety valve to prevent the un-controlled flow of hydrocarbon fluids in the event of surface equipment failure, such as damage to a wellhead, as a qualified well control barrier. Alternately, a subsurface safety valve can be used to provide for surface line de-pressurization and isolation with a zero pressure reading, for example so that an offshore rig move can be safely performed.

Some current surface controlled subsurface safety valves are made up as part of the tubing string or inserted into the tubing string, and can be held in an open position. When the valve member is to be closed, the valve member is no longer held open and reverts to a closed position. Some current surface controlled subsurface safety valves can include a flapper, split or clamshell type valve member. Because subsurface safety valves can be used in emergency conditions, it is important that the valve member be free of leaks, in particular in the closed position.

SUMMARY OF THE DISCLOSURE

Some currently available subsurface safety valves have valve members that close against metal surfaces and therefore may not provide a complete seal when closed. Such valve members can instead allow for pressure and fluids to pass through the valve. Embodiments disclosed herein provide a leak-free subsurface safety valve that can be a qualified well control barrier, or can provide for surface line de-pressurization and isolation with a zero pressure reading. System and methods of this disclosure use an internal rotating disk with seal members that can seal against a fluid flow or pressure through the tubing string in a leak-free manner.

In an embodiment of this disclosure, a subsurface safety valve assembly for a subterranean well has a valve body. The valve body has an axially oriented valve bore extending from a downhole end of the valve body to an uphole end of the valve body. The valve body also has a valve cavity. The valve cavity is an open space intersecting the valve bore within the valve body. A disk valve member is positioned within the valve cavity. The disk valve member is disk shaped and has a disk bore extending from a downhole side to an uphole side of the disk valve member. A piston member has a base end rotationally secured to the valve body and an extendable end rotationaly secured to the disk valve member. The piston member is moveable between a contracted position and an extended position, such that in the contracted position the disk valve member is oriented in a valve closed position with the disk bore offset from the valve bore, and in the extended position the disk valve member is oriented in a valve open position with the disk bore axially aligned with the valve bore. An uphole seal member circumscribes the valve bore at a downhole facing surface of the valve cavity, forming a seal between the uphole side of the disk valve member and the valve body. A downhole seal member circumscribes the valve bore at an uphole facing surface of the valve cavity, forming a seal between the downhole side of the disk valve member and the valve body.

In alternate embodiments, the assembly can further include a biasing member, the biasing member urging the disk valve member towards the valve closed position. A hydraulic fluid line can be in fluid communication with the piston member and be operable to provide a hydraulic fluid force to retain the piston member in the extended position. A rotation rod can extend in an axial direction between the disk valve member and the valve body. The rotation rod can be positioned so that the disk valve member rotates between the valve open position and the valve closed position about the rotation rod.

In other alternate embodiments, the uphole seal member and the downhole seal member can remain static relative to the valve body as the disk valve member rotates between the valve open position and the valve closed position. The uphole seal member can include a primary uphole seal and a secondary uphole seal, the primary uphole seal circumscribing the secondary uphole seal. The downhole seal member can include a primary downhole seal and a secondary downhole seal, the primary downhole seal circumscribing the secondary downhole seal.

In another embodiment of this disclosure, a subsurface safety valve assembly for a subterranean well has a valve body located within the subterranean well. The valve body has an axially oriented valve bore having a downhole opening at a downhole end of the valve body and an uphole opening at an uphole end of the valve body. The downhole opening is in fluid communication with a downhole production tubular. The uphole opening is in fluid communication with an uphole production tubular. A valve cavity is an open space intersecting the valve bore within the valve body. A disk valve member is positioned within the valve cavity. The disk valve member is disk shaped and has a disk bore extending from a downhole side to an uphole side of the disk valve member. An uphole seal member circumscribes the valve bore at a downhole facing surface of the valve cavity, forming a seal between the uphole side of the disk valve member and the valve body. A downhole seal member circumscribes the valve bore at an uphole facing surface of the valve cavity, forming a seal between the downhole side of the disk valve member and the valve body. The disk valve member is moveable between a valve closed position with the disk bore offset from the valve bore, and a valve open position with the disk bore axially aligned with the valve bore.

In alternate embodiments, a biasing member can have a biasing force that urges the disk valve member towards the valve closed position. An actuation member can be operable to move the disk valve member from the valve closed position to the valve open position and maintain the disk valve member in the valve open position against the biasing force. A rotation rod can extend in an axial direction between the disk valve member and the valve body, the rotation rod positioned so that the disk valve member rotates between the valve open position and the valve closed position about the rotation rod. The biasing member can be a torque spring that circumscribes the rotation rod.

In another alternate embodiment of this disclosure, a method for controlling a flow of fluid within a subterranean well with a subsurface safety valve assembly includes securing the subsurface safety valve assembly between an uphole production tubular and a downhole production tubular. The subsurface safety valve assembly has a valve body. The valve body has an axially oriented valve bore extending from a downhole end of the valve body to an uphole end of the valve body. The valve body also has a valve cavity, the valve cavity being an open space intersecting the valve bore within the valve body. A disk valve member is positioned within the valve cavity. The disk valve member is disk shaped and has a disk bore extending from a downhole side to an uphole side of the disk valve member. A piston member has a base end rotationally secured to the valve body and an extendable end rotationaly secured to the disk valve member. An uphole seal member circumscribes the valve bore at a downhole facing surface of the valve cavity, forming a seal between the uphole side of the disk valve member and the valve body. A downhole seal member circumscribes the valve bore at an uphole facing surface of the valve cavity, forming a seal between the downhole side of the disk valve member and the valve body. The piston member moves between a contracted position and an extended position, such that in the contracted position the disk valve member is oriented in a valve closed position with the disk bore offset from the valve bore, and in the extended position the disk valve member is oriented in a valve open position with the disk bore axially aligned with the valve bore.

In alternate embodiments, the axially oriented valve bore can have a downhole opening at the downhole end of the valve body and an uphole opening at the uphole end of the valve body. The downhole opening can be in fluid communication with the downhole production tubular. The uphole opening can be in fluid communication with the uphole production tubular. The method can further include preventing the flow of fluid from traveling between the downhole production tubular and the uphole production tubular by moving the disk valve member from the valve open position to the valve closed position.

In other alternate embodiments, the method can further include urging the disk valve member towards the valve closed position with a biasing member of the subsurface safety valve assembly. A hydraulic fluid force can be provided to retain the piston member in the extended position by way of a hydraulic fluid line, the hydraulic fluid line in fluid communication with the piston member. The disk valve member can rotate between the valve open position and the valve closed position about a rotation rod. The rotation rod can extend in an axial direction between the disk valve member and the valve body. The uphole seal member and the downhole seal member can remain static relative to the valve body as the disk valve member rotates between the valve open position and the valve closed position.

BRIEF DESCRIPTION OF THE DRAWINGS

So that the manner in which the above-recited features, aspects and advantages of the embodiments of this disclosure, as well as others that will become apparent, are attained and can be understood in detail, a more particular description of the disclosure briefly summarized above may be had by reference to the embodiments thereof that are illustrated in the drawings that form a part of this specification. It is to be noted, however, that the appended drawings illustrate only preferred embodiments of the disclosure and are, therefore, not to be considered limiting of the disclosure's scope, for the disclosure may admit to other equally effective embodiments.

DETAILED DESCRIPTION

Embodiments of the present disclosure will now be described more fully hereinafter with reference to the accompanying drawings which illustrate embodiments of the disclosure. Systems and methods of this disclosure may, however, be embodied in many different forms and should not be construed as limited to the illustrated embodiments set forth herein. Rather, these embodiments are provided so that this disclosure will be thorough and complete, and will fully convey the scope of the disclosure to those skilled in the art. Like numbers refer to like elements throughout, and the prime notation, if used, indicates similar elements in alternative embodiments or positions.

In the following discussion, numerous specific details are set forth to provide a thorough understanding of the present disclosure. However, it will be obvious to those skilled in the art that embodiments of the present disclosure can be practiced without such specific details. Additionally, for the most part, details concerning well drilling, reservoir testing, well completion and the like have been omitted inasmuch as such details are not considered necessary to obtain a complete understanding of the present disclosure, and are considered to be within the skills of persons skilled in the relevant art.

Figure 1:
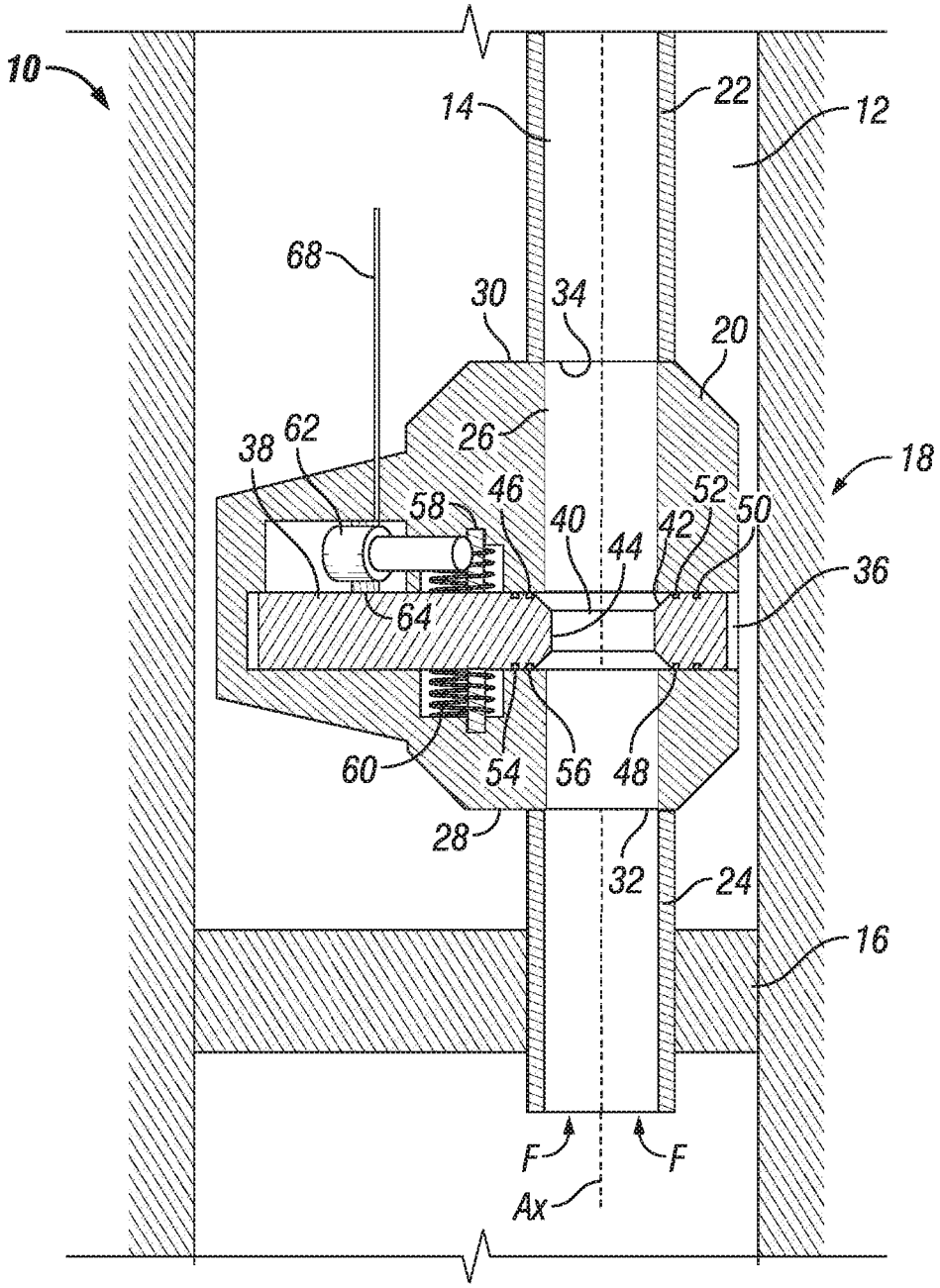
FIG. 1 is an elevation section view of a subsurface safety valve, in accordance with an embodiment of this disclosure, shown in a valve open position.

Looking at FIG. 1, subterranean well 10 includes wellbore 12. Subterranean well 10 can be a cased well or an uncased well, or can include portions that are cased and other portions that are uncased. Tubing string 14 can extend into wellbore 12 and have a central tubing bore for delivering produced fluids to the surface. Tubing string 14 can extend along tubing axis Ax. Tubing string 14 can be supported by a tubing hanger (not shown).

Tubing string 14 can additionally or alternately be supported by packer assembly 16 that circumscribes tubing string 14. Packer assembly 16 can include sealing members, gripping members, or a combination of sealing and gripping members. As an example, packer assembly 16 can form an annular seal between the outer surface of tubing string 14 and the inner surface of wellbore 12 with sealing members. Packer assembly 16 can alternately grip the inner surface of wellbore 12 with gripping members.

In order to produce wellbore fluids to the surface, a flow of fluids, indicated by the arrow labeled F, can enter tubing string 14 through a downhole end of tubing string 14 and travel uphole. The flow of fluids can be prevented from traveling to the surface through the annular space outside of tubing string 14 and inside of wellbore 12 by packer assembly 16.

There may be times when it is desirable to stop of the flow of wellbore fluids through tubing string 14. As an example, if there is a failure of the surface equipment that is controlling the flow of wellbore fluids at the surface, there can be a risk of an uncontrolled fluid of fluids out of subterranean well 10. Alternately, there may be times when routine maintenance or repairs, or planned operations would benefit from stopping the flow of fluids through tubing string 14 at a downhole location within wellbore 12. In each such case, subsurface safety valve assembly 18 can be used to control the flow of fluid within subterranean well 10.

Subsurface safety valve assembly 18 includes valve body 20. Valve body 20 can be formed of, as an example, a stainless steel, such as a 9Cr-1Mo stainless steel. Valve body 20 can be sized to be located within wellbore 12 of subterranean well 10. Valve body 20 can be secured in line with tubing string 14 so that subsurface safety valve assembly 18 is located between uphole production tubular 22 of tubing string 14 and downhole production tubular 24 of tubing string 14. As an example, valve body 20 can be threaded to uphole production tubular 22 and downhole production tubular 24.

Valve body 20 can further include valve bore 26. Valve bore 26 is axially oriented and extends from a downhole end 28 of valve body 20 to an uphole end 30 of valve body 20. Valve bore 26 has downhole opening 32 at downhole end 28 of valve body 20 that is in fluid communication with the central tubing bore of downhole production tubular 24. Valve bore 26 also has uphole opening 34 at uphole end 30 of valve body 20 that is in fluid communication with the central tubing bore of uphole production tubular 22.

Valve body 20 also includes valve cavity 36. Valve cavity 36 is an open space within valve body 20 that intersects valve bore 26. Valve cavity 36 is sized to house disk valve member 38 that is positioned within valve cavity 36. Disk valve member 38 can be generally disk shaped and formed of, as an example, a stainless steel, such as a 9Cr-1Mo stainless steel.

Disk valve member 38 has disk bore 40 that extends in an axial direction from a downhole side of disk valve member 38 to an uphole side of disk valve member 38. In the embodiment of FIG. 1, disk bore 40 has a diameter at the downhole side and the uphole side of disk valve member 38 that is larger than the diameter of valve bore 26. At the uphole side and the downhole side of disk valve member 38 disk bore 40 has a frustoconical shape with sloped surfaces 42. A central portion 44 of disk bore 40 has a cylindrical shape with a diameter that is smaller than the diameter of valve bore 26. Sloped surface 42 helps to prevent erosion and wash out due to abrasive sand from the reservoir. Slopes surface 42 also assists to guide any wireline intervention tool through disk bore 40.

Figure 2:
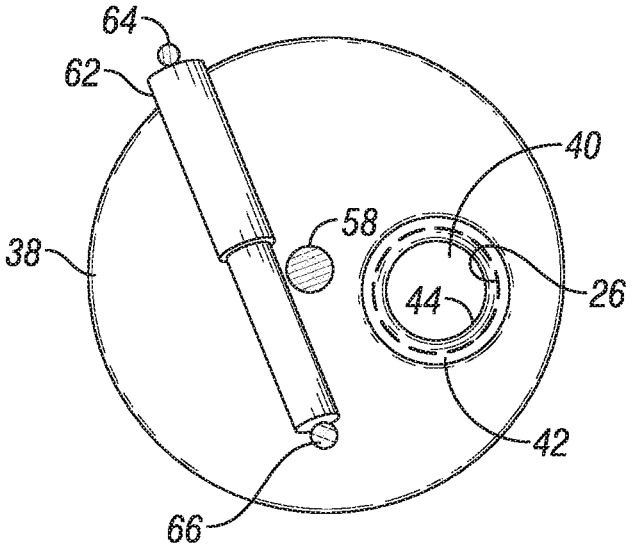
FIG. 2 is a cross section view of a disk valve member of a subsurface safety valve, in accordance with an embodiment of this disclosure, shown in a valve open position.
Figure 4:
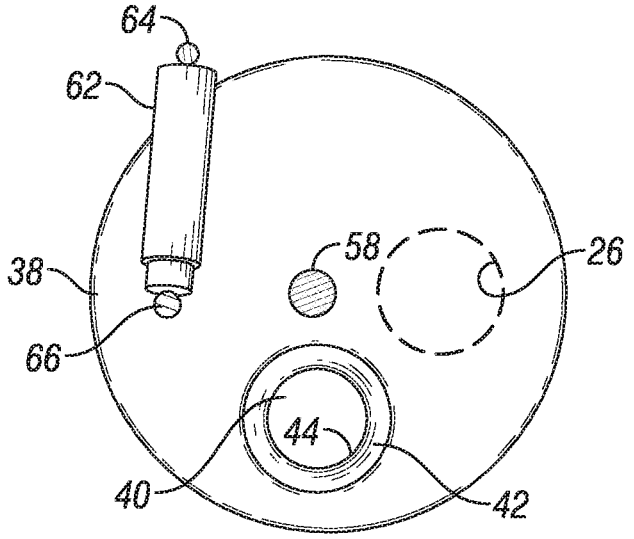
FIG. 4 is a cross section view of the disk valve member of the subsurface safety valve of FIG. 2, shown in a valve closed position.
Figure 3:
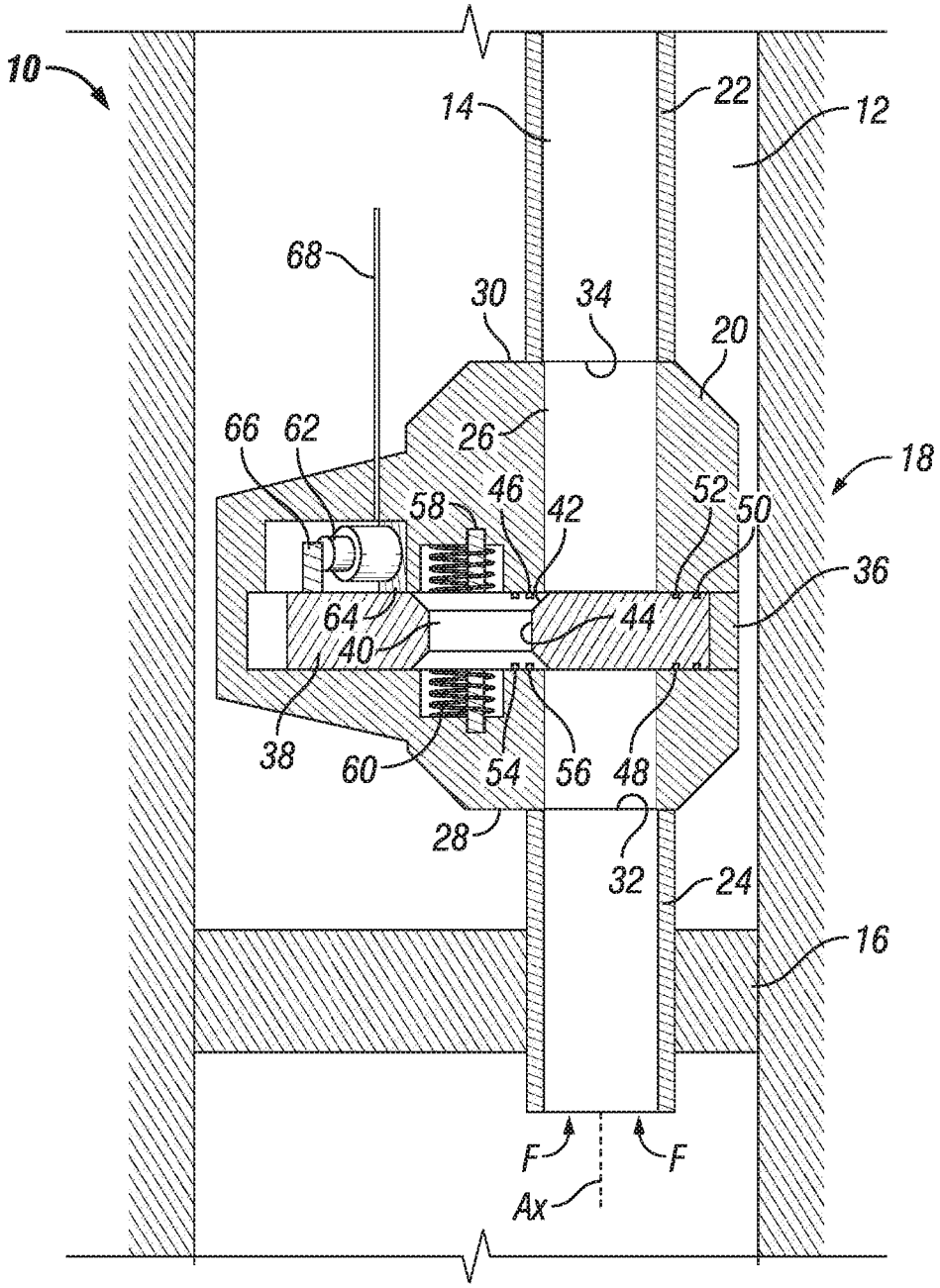
FIG. 3 is an elevation section view of the subsurface safety valve of FIG. 1, shown in a valve closed position.

Disk valve member 38 is moveable between a valve open position and a valve closed position. In the valve open position, disk bore 40 is axially aligned with valve bore 26 (FIG. 1 and FIG. 2). In the valve open position, a flow of fluids can pass through subsurface safety valve assembly 18. In the valve closed position, disk bore 40 is offset from valve bore 26 (FIG. 3 and FIG. 4). In the valve closed position, a fluids and pressure is prevented from passing through subsurface safety valve assembly 18. Therefore, when an operator desires to prevent a flow of fluid from traveling between downhole production tubular 24 and uphole production tubular 22, disk valve member 38 can be moved from the valve open position of FIGS. 1-2 to the valve closed position of FIGS. 3-4.

Looking at FIGS. 1 and 3, uphole seal member 46 circumscribes valve bore 26 at a downhole facing surface of valve cavity 36. Uphole seal member 46 forms a seal between the uphole side of disk valve member 38 and valve body 20. Downhole seal member 48 circumscribes valve bore 26 at an uphole facing surface of valve cavity 36, forming a seal between the downhole side of disk valve member 38 and valve body 20. Uphole seal member 46 and downhole seal member 48 not only prevent fluids and pressure from passing between the uphole side of disk valve member 38 and valve body 20 but can also prevent any debris from the produced reservoir fluids from filling the voids around disk valve member 38, which could jam disk valve member 38 and prevent disk valve member 38 from rotating. Uphole seal member 46 and downhole seal member 48 can be formed of, a material that is capable of withstanding downhole pressures and temperatures and that is resistant to hydrogen sulfide, such as a copolymer of tetrafluoroethylene and propylene Disk valve member 38 is fit between uphole seal member 46 and downhole seal member 48 so that uphole seal member 46 and downhole seal member 48 are in continuous contact with disk valve member 38. Uphole seal member 46 and downhole seal member 48 remain static relative to valve body 20 as disk valve member 38 rotates between the valve open position and the valve closed position. Because uphole seal member 46 and downhole seal member 48 are in constant contact with disk valve member 38, the sealing integrity of subsurface safety valve assembly 18 is maintained both while disk valve member 38 is in the valve open position and the valve closed position.

In the example embodiments of FIGS. 1 and 3, uphole seal member 46 includes primary uphole seal 50 and secondary uphole seal 52. Primary uphole seal 50 circumscribes secondary uphole seal 52. In the example embodiments of FIGS. 1 and 3, downhole seal member 48 includes primary downhole seal 54 and secondary downhole seal 56. Primary downhole seal 54 circumscribes secondary downhole seal 56. In alternate embodiments, there may be only one uphole seal and one downhole seal. However, having both a primary seal and a secondary seal can allow for improved sealing compared to embodiments that have only one uphole seal and one downhole seal. In other alternate embodiments there may be additional uphole seals and additional downhole seals.

Subsurface safety valve assembly 18 further includes rotation rod 58. Rotation rod 58 extends in a generally axial direction between disk valve member 38 and valve body 20. Rotation rod 58 extends from a center of disk valve member 38 and is positioned so that disk valve member 38 rotates between the valve open position and the valve closed position about rotation rod 58.

Disk valve member 38 is biased towards the valve closed position, as shown in FIG. 3. Biasing member 60 urges disk valve member 38 towards the valve closed position. Biasing member 60 applies a biasing force on disk valve member 38 to urge disk valve member 38 towards the valve closed position and maintain disk valve member 38 in the valve closed position. In the example embodiments of FIGS. 1 and 3, biasing member 60 is a torque spring that circumscribes rotation rod 58. In the Examiner embodiments, biasing member 60 includes two torque springs with one torque spring being located uphole of disk valve member 38 and a second torque spring being located downhole of disk valve member 38.

Actuation member 62 of subsurface safety valve assembly 18 can be used to overcome the biasing force of biasing member 60 to move disk valve member 38 to the valve open position. Actuation member 62 can maintain disk valve member 38 in the valve open position against the biasing force of biasing member 60. In the example embodiments of FIGS. 1 and 3, actuation member 62 is a piston member.

The piston member can have base end 64 that is rotationally secured to valve body 20. The piston member can also have extendable end 66 that is opposite base end 64 and is rotationaly secured to disk valve member 38. The piston member is moveable between a contracted position of FIG. 4 and an extended position of FIG. 2. In the example embodiments, when the piston member is in the contracted position, disk valve member 38 is oriented in a valve closed position with disk bore 40 offset from valve bore 26 (shown as a dotted circle for reference only in FIG. 4). In the example embodiments, when the piston member is in the extended position, disk valve member 38 is oriented in a valve open position with disk bore 40 axially aligned with valve bore 26 (shown as a dotted circle for reference only in FIG. 2).

The piston member can be a hydraulically actuated piston device. Hydraulic fluid line 68 can be in fluid communication with the piston member. Hydraulic fluid line 68 can provide a hydraulic fluid to the piston member. The hydraulic fluid can provide a hydraulic fluid force that is sufficient to move the piston member from the contracted position of FIG. 4 to the extended position of FIG. 2. The hydraulic fluid can further provide a hydraulic fluid force that is sufficient to retain the piston member in the extended position against the biasing force of biasing member 60. If the operator purposefully reduces or eliminates the hydraulic fluid force the biasing force of biasing member 60 would return piston member to the contracted position as disk valve member 38 rotates to the valve closed position. If an equipment failure or emergency situation reduces or eliminates the hydraulic fluid force, the biasing force of biasing member 60 would return piston member to the contracted position as disk valve member 38 rotates to the valve closed position.

In an example of operation when completing subterranean well 10 subsurface safety valve assembly 18 can be made up as part of tubing string 14 and lowered into wellbore 12. Biasing member 60 can maintain disk valve member 38 in a valve closed position until hydraulic fluid is provided to actuation member 62. The hydraulic fluid can be provided by way of hydraulic fluid line 68 and cause the piston member to move from the contracted position of FIG. 4 to the extended position of FIG. 2. As the piston member moves to the extended position, disk valve member 38 is moved to a valve open position.

If the hydraulic pressure is reduced or eliminated, the biasing force of biasing member 60 returns the piston member to the contracted position as disk valve member 38 rotates to the valve closed position. With the disk valve member 8 in the valve closed position, uphole seal member 46 and downhole seal member 48 are in continuous contact with disk valve member 38. Uphole seal member 46 and downhole seal member 48 remain static relative to valve body 20 as disk valve member 38 rotates between the valve open position and the valve closed position. Because uphole seal member 46 and downhole seal member 48 are in constant contact with disk valve member 38, the sealing integrity of subsurface safety valve assembly 18 is maintained both while disk valve member 38 is in the valve open position and the valve closed position.

Therefore, as disclosed herein, embodiments of the systems and methods of this disclosure will provide a subsurface safety valve assembly with improved sealing capabilities compared to some currently available valves. Embodiments of this disclosure provide a subsurface safety valve assembly that can prevent leakage of pressure and fluids when the disk valve member is rotated to the valve closed position.

Embodiments of the disclosure described herein, therefore, are well adapted to carry out the objects and attain the ends and advantages mentioned, as well as others inherent therein. While a presently preferred embodiment of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A subsurface safety valve assembly for a subterranean well, the assembly having:

a valve body, the valve body having:

an axially oriented valve bore extending from a downhole end of the valve body to an uphole end of the valve body; and a valve cavity, the valve cavity being an open space intersecting the valve bore within the valve body;

a disk valve member positioned within the valve cavity, the disk valve member being disk shaped and having a disk bore extending from a downhole side to an uphole side of the disk valve member;

a piston member having a base end rotationally secured to the valve body and an extendable end rotationaly secured to the disk valve member, where the piston member is moveable between a contracted position and an extended position, such that in the contracted position the disk valve member is oriented in a valve closed position with the disk bore offset from the valve bore, and in the extended position the disk valve member is oriented in a valve open position with the disk bore axially aligned with the valve bore;

an uphole seal member circumscribing the valve bore at a downhole facing surface of the valve cavity, forming a seal between the uphole side of the disk valve member and the valve body; and a downhole seal member circumscribing the valve bore at an uphole facing surface of the valve cavity, forming a seal between the downhole side of the disk valve member and the valve body.

2. The assembly of claim 1, further including a biasing member, the biasing member urging the disk valve member towards the valve closed position.

3. The assembly of claim 1, further including a hydraulic fluid line, the hydraulic fluid line in fluid communication with the piston member and operable to provide a hydraulic fluid force to retain the piston member in the extended position.

4. The assembly of claim 1, further including a rotation rod, the rotation rod extending in an axial direction between the disk valve member and the valve body, the rotation rod positioned so that the disk valve member rotates between the valve open position and the valve closed position about the rotation rod.

5. The assembly of claim 1, where the uphole seal member and the downhole seal member remain static relative to the valve body as the disk valve member rotates between the valve open position and the valve closed position.

6. The assembly of claim 1, where the uphole seal member includes a primary uphole seal and a secondary uphole seal, the primary uphole seal circumscribing the secondary uphole seal.

7. The assembly of claim 1, where the downhole seal member includes a primary downhole seal and a secondary downhole seal, the primary downhole seal circumscribing the secondary downhole seal.

8. A subsurface safety valve assembly for a subterranean well, the assembly having:

a valve body located within the subterranean well, the valve body having:

an axially oriented valve bore having a downhole opening at a downhole end of the valve body and an uphole opening at an uphole end of the valve body, where the downhole opening is in fluid communication with a downhole production tubular, and where the uphole opening is in fluid communication with an uphole production tubular; and a valve cavity, the valve cavity being an open space intersecting the valve bore within the valve body;

a disk valve member positioned within the valve cavity, the disk valve member being disk shaped and having a disk bore extending from a downhole side to an uphole side of the disk valve member;

an uphole seal member circumscribing the valve bore at a downhole facing surface of the valve cavity, forming a seal between the uphole side of the disk valve member and the valve body; and a downhole seal member circumscribing the valve bore at an uphole facing surface of the valve cavity, forming a seal between the downhole side of the disk valve member and the valve body; where the disk valve member is moveable between a valve closed position with the disk bore offset from the valve bore, and a valve open position with the disk bore axially aligned with the valve bore.

9. The assembly of claim 8, further including a biasing member, the biasing member having biasing force that urges the disk valve member towards the valve closed position.

10. The assembly of claim 9, further including an actuation member operable to move the disk valve member from the valve closed position to the valve open position and maintain the disk valve member in the valve open position against the biasing force.

11. The assembly of claim 8, further including a rotation rod, the rotation rod extending in an axial direction between the disk valve member and the valve body, the rotation rod positioned so that the disk valve member rotates between the valve open position and the valve closed position about the rotation rod.

12. The assembly of claim 11, further including a biasing member that urges the disk valve member towards the valve closed position, where the biasing member is a torque spring that circumscribes the rotation rod.

13. A method for controlling a flow of fluid within a subterranean well with a subsurface safety valve assembly, the method including:

securing the subsurface safety valve assembly between an uphole production tubular and a downhole production tubular, the subsurface safety valve assembly having:

a valve body, the valve body having an axially oriented valve bore extending from a downhole end of the valve body to an uphole end of the valve body, and a valve cavity, the valve cavity being an open space intersecting the valve bore within the valve body;

a disk valve member positioned within the valve cavity, the disk valve member being disk shaped and having a disk bore extending from a downhole side to an uphole side of the disk valve member;

a piston member having a base end rotationally secured to the valve body and an extendable end rotationaly secured to the disk valve member;

an uphole seal member circumscribing the valve bore at a downhole facing surface of the valve cavity, forming a seal between the uphole side of the disk valve member and the valve body; and a downhole seal member circumscribing the valve bore at an uphole facing surface of the valve cavity, forming a seal between the downhole side of the disk valve member and the valve body; and moving the piston member between a contracted position and an extended position, such that in the contracted position the disk valve member is oriented in a valve closed position with the disk bore offset from the valve bore, and in the extended position the disk valve member is oriented in a valve open position with the disk bore axially aligned with the valve bore.

14. The method of claim 13, were the axially oriented valve bore has a downhole opening at the downhole end of the valve body and an uphole opening at the uphole end of the valve body, where the downhole opening is in fluid communication with the downhole production tubular, and where the uphole opening is in fluid communication with the uphole production tubular, and the method further includes preventing the flow of fluid from traveling between the downhole production tubular and the uphole production tubular by moving the disk valve member from the valve open position to the valve closed position.

15. The method of claim 13, further including urging the disk valve member towards the valve closed position with a biasing member of the subsurface safety valve assembly.

16. The method of claim 13, further including providing a hydraulic fluid force to retain the piston member in the extended position by way of a hydraulic fluid line, the hydraulic fluid line in fluid communication with the piston member.

17. The method of claim 13, where the disk valve member rotates between the valve open position and the valve closed position about a rotation rod, the rotation rod extending in an axial direction between the disk valve member and the valve body.

18. The method of claim 13, where the uphole seal member and the downhole seal member remain static relative to the valve body as the disk valve member rotates between the valve open position and the valve closed position.

* * * * *